United States Patent [19]

Pardes et al.

[11] 3,996,674

[45] Dec. 14, 1976

[54] DISTRIBUTION OF FIRE DISPLAY TECHNIQUE FOR MOVING TARGET SCREENS

[75] Inventors: Herman I. Pardes, Wanamassa; Joseph R. Schwartz, Toms River, both of N.J.

[73] Assignee: The United States of America as represented by the Secretary of the Army, Washington, D.C.

[22] Filed: Jan. 29, 1976

[21] Appl. No.: 653,312

[52] U.S. Cl. ..... 35/25; 273/101.1

[51] Int. Cl.[2] ..... F41G 3/26

[58] Field of Search ..... 35/25; 273/101.1, 101.2

[56] References Cited

UNITED STATES PATENTS

| | | | |
|---|---|---|---|
| 2,662,305 | 12/1953 | Alric | 35/25 |
| 3,838,856 | 10/1974 | Takeya et al. | 35/25 X |
| 3,888,022 | 6/1975 | Pardes et al. | 35/25 |

*Primary Examiner*—William H. Grieb
*Attorney, Agent, or Firm*—Nathan Edelberg; Robert P. Gibson; Daniel D. Sharp

[57] ABSTRACT

A system for displaying target information on a realistic simulated target scene presented by a motion picture film projector. The target information is derived from laser carrying weapons which are aimed at the simulated targets. The impact point of the laser beam on the target screen are optically projected onto the target screen as spots to provide a visual presentation of the distribution of fire of the laser carrying weapons.

6 Claims, 1 Drawing Figure

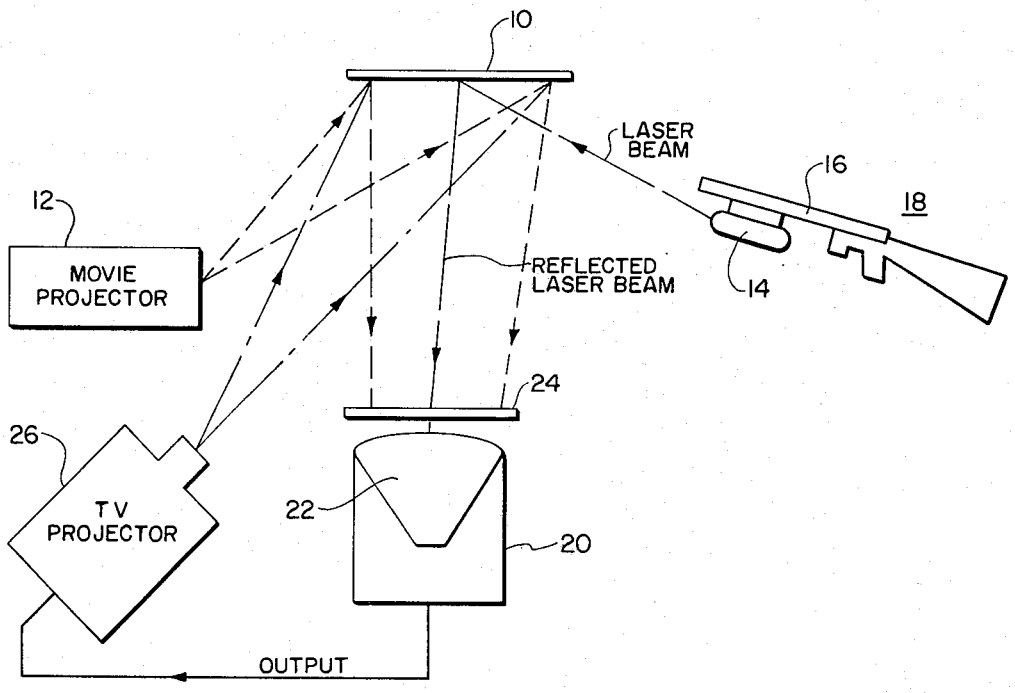
10
LASER BEAM
16
18
12
MOVIE PROJECTOR
REFLECTED LASER BEAM
14
24
26
TV PROJECTOR
22
20
OUTPUT

DISTRIBUTION OF FIRE DISPLAY TECHNIQUE FOR MOVING TARGET SCREENS

The invention described herein may be manufactured, used and licensed by or for the Government for governmental purposes without the payment of any royalties thereon.

BACKGROUND OF THE INVENTION

This invention relates to an electro-optical training device for weapons firing and more particularly to a system for visually illustrating the distribution of fire from such weapons on a simulated target scene.

In U.S. Pat. No. 3,888,022, issued June 10, 1975, there is shown an electro-optical indoor training device which permits operators of one or more laser carrying weapons to aim at a realistic simulated target scene presented by a motion picture film projector. Each frame of the film contains a first portion representing a scene including at least one target area at which the laser beam of any given weapon should be directed, and a second portion which is substantially opaque to laser radiation except for a transparent region thereof corresponding in location exactly to the location of the target area in the first portion of the film frame. Each weapon has a low power laser attached thereto which can be excited by actuating the weapon trigger and by automatic electronic delay, thereby firing the laser at previously determined time intervals. The laser beam, if properly aimed at preselected areas of the target scene on the projection screen will be focused on a hit detection means, whereas an improperly aimed laser beam will impinge upon an attempt detection means to record the miss. Attempts and hits for all involved weapons are scored on an individual basis by electronic display means remote and separate from the screen upon which the realistic simulated target scenes are presented. The scoring display means is monitored by an instructor observer who relays information to the firer so that the latter may adjust his aim for correct firing. Such remote observations are both time consuming and inefficient since the firer is only guided by the instructor observer information.

SUMMARY OF THE INVENTION

In accordance with the present invention, there is provided a system for showing the distribution of gun weapon fire on a screen upon which are projected simulated moving targets and wherein a pulse laser beam is directed at respective moving targets when the gun weapons are fired. Included in the system is a TV camera having a pick-up lens focused on the simulated target screen. Also included are means in front of the pick-up lens for permitting only reflected laser beam pulses to pass to the TV camera to produce respective spots corresponding to respective laser pulses. Included further are means responsive to the output of the TV camera for optically projecting the spots on the moving target screen whereby the respective spots provide a visual indication of a hit or miss of selected targets on the moving target screen.

BRIEF DESCRIPTION OF THE DRAWING

The single drawing illustrates a block diagram of the preferred embodiment of the present invention.

DESCRIPTION OF THE PREFERRED EMBODIMENT

Referring now to the drawing 10 is the viewing screen upon which the simulated target scene is projected from movie projector 12. The laser beam from the laser 14 mounted on the barrel 16 of weapon 18 is directed at the moving target on viewing screen 10. As indicated in the aforementioned patent, the laser 14 is a 0.81 micrometer gallium arsenide laser with a beam spread of about 3 milliradians. The laser output is of the order of 6 watts in a 100 nanosecond pulse, and, as such, presents no hazard to the eye of the operator. Since the gallium arsenide laser pulse is in the infrared spectrum, it is not visible to the human eye and cannot be seen on moving target screen 10. The projected scene is viewed by a TV camera 20 provided with a vidicon tube 22 which has a spectral peak between 0.8 and 0.9 micrometers. Such tubes are well known in the art and are available commercially. A narrow-band optical filter 24 centered at the laser frequency of 0.81 micrometers is positioned in front of the TV camera 20 pick-up lens. The filter 24 attenuates the projected movie scene on screen 10 and only allows the reflected laser pulses to pass through filter 24 and impinge or strike the surface of the vidicon tube 22 of TV camera 20. The output of the TV camera 20 is fed to a high-intensity projection type display monitor 26 whose output is optically superimposed on the simulated target scene projected on screen 10. Such high intensity projection type display monitors are well known in the art and are usually referred to as TV projectors. Initial alignment between the simulated target scene and the output of TV projector 26 is accomplished by viewing the simulated target scene on the TV projector 26 and adjusting the horizontal and vertical size controls of TV projector 26 until the scenes are in perfect registration. The output of TV projector 26 will cause the laser target pulses to appear as dots on screen 10 in the exact position as they were aimed by the firer. Thus each time the weapon firer pulls the trigger, a light spot is instantly projected on screen 10 to provide the desired target visual presentation of the distribution of fire. The scenes can be recorded on video tape for replay and critique by the instructor. The system efficiency of the system shown in the drawing is considerably enhanced since the system can be operated at maximum current and voltage and is responsive only to the very short duration laser pulse. The retentivity of the vidicon tube surface of TV camera 20 precludes the necessity of synchronizing the TV camera 20 (30 frames per second) to the movie projector 12 (24 frames per second) to insure display of all shots.

What is claimed is:

1. A system for showing the distribution of gun weapon fire on a screen upon which are projected moving targets and wherein a pulse laser beam is directed at respective moving targets when said weapon is fired, said system comprising:

a TV camera having its pick-up lens focused on said target screen;

means in front of said pick-up lens for permitting only reflected laser beam pulses to pass to said TV camera to produce respective spots corresponding to respective laser pulses; and means responsive to the output of said TV camera for optically projecting said spots on said screen whereby the respective spots provide a visual indication of a hit or miss of a selected target on said screen.

2. The system in accordance with claim 1 wherein said first mentioned means comprises a narrow band optical filter centered at the frequency of said laser beam.

3. The system in accordance with claim 2 wherein the center of said narrow band filter is 0.81 micrometers.

4. The system in accordance with claim 1 wherein said TV camera includes a vidicon type tube having a spectral peak between 0.8 and 0.9 micrometers.

5. The system in accordance with claim 4 wherein said first mentioned means comprises a narrow band optical filter centered at the frequency of said laser beam.

6. The system in accordance with claim 5 wherein the center of said narrow band filter is 0.81 micrometers.

* * * * *